United States Patent [19]

Schill

[11] Patent Number: 4,519,607

[45] Date of Patent: May 28, 1985

[54] GAME TABLE

[75] Inventor: Alfred G. Schill, Noble Park, Australia

[73] Assignee: Prestige Billiards Pty. Ltd., Victoria, Australia

[21] Appl. No.: 400,270

[22] Filed: Jul. 21, 1982

[30] Foreign Application Priority Data

Mar. 12, 1982 [AU] Australia ..... 81373/82

[51] Int. Cl.[3] ..... A63D 15/00

[52] U.S. Cl. ..... 273/5 B; 108/90; 312/282; 312/313

[58] Field of Search ..... 108/6, 8, 17, 77, 78, 108/117, 138, 139, 143, 93, 49, 69, 90, 49, 83; 312/312, 282, 313; 273/5 R, 5 A, 5 B, 5 C

[56] References Cited

U.S. PATENT DOCUMENTS

| | | | |
|---|---|---|---|
| 843,719 | 2/1907 | Umberger | 312/313 |
| 1,875,198 | 8/1932 | Nagai | 273/3 A |
| 2,008,613 | 7/1935 | Hernes | 273/5 R |
| 2,524,386 | 10/1950 | Johnston | 108/93 |
| 3,080,835 | 3/1963 | Guglielmi | 108/147 |
| 3,088,421 | 5/1963 | Ferris | 108/13 |
| 3,145,668 | 8/1964 | Pantazos | 108/93 |
| 3,174,722 | 3/1965 | Alm | 108/147 |
| 3,339,873 | 9/1967 | Hale | 108/147 |
| 4,343,244 | 8/1982 | Moriority | 312/313 |
| 4,374,497 | 2/1983 | Harmand | 108/147 |

FOREIGN PATENT DOCUMENTS

| | | | |
|---|---|---|---|
| 833518 | 10/1938 | France | 273/5 R |
| 282935 | 2/1931 | Italy | 273/3 R |

*Primary Examiner*—Richard C. Pinkham
*Assistant Examiner*—T. Brown
*Attorney, Agent, or Firm*—Memel, Jacobs, Pierno, Gersh and Ellsworth

[57] ABSTRACT

A games table comprising a first games playing surface and a second table top surface normally disposed above the games playing surface, the second table top surface being formed by two panel elements or two groups of panel elements connected to the games playing surface whereby the panel elements can be moved bodily and pivoted to a non-vertical position adjacent to and substantially below the level of the games playing surface, and an elevating mechanism being provided to enable the games playing surface to be moved to a level suitable for use as a games table.

4 Claims, 7 Drawing Figures

GAME TABLE

The present invention relates to games tables, particularly such tables which are convertible for other uses. The invention is particularly directed towards billiards or snooker tables which are convertible for use as dining tables, however it will be appreciated that other types of games might equally come within the scope of the invention.

It is currently known to provide a games table, such as a snooker or billiards table, with a removable top which enables the table to also double as a dining room table. Such conversions have, to some extent, been satisfactory however they do suffer from certain disadvantages. Firstly, it is usually necessary to bodily remove a dining room table top from the games table when it is desired to use the table as a games table. This can be a difficult, heavy and cumbersome task which can prove almost impossible for some people. Furthermore the table top has to be physically stored away from the table to allow the game to proceed. Secondly, the height of games tables and dining room tables differ quite significantly. If a compromise is sought, the dining room table mode of operation is usually too high and the games table operation is usually too low. The objective of the present invention is to provide a convertible games table which substantially eliminates or minimizes the aforementioned disadvantages.

According to the present invention, a games table is a first table top surface adapted for use as a games playing surface having support means supporting the first table top surface at a predetermined height above ground level, a second table top surface formed by at least two elements, said elements being adapted to form a single co-extensive surface in a first position thereof arranged above said first table top surface, and means arranged to support said elements of the second table top surface relative to said first table top surface, said means enabling bodily movement and pivotable movement of said elements to a second position wherein the elements are arranged adjacent to and substantially below the level of said first table top surface.

According to a second aspect of the present invention there is provided a games table comprising a first table top surface adapted for use as a games playing surface having support means supporting the first table top surface at a first predetermined height above ground level, said first table top surface being connected to the support means by an elevation mechanism whereby said first table top surface can be moved to a second predetermined height above ground level. Conveniently the elevation mechanism comprises a plurality of pressurized cylinders having telescopic piston members adapted to be clamped in a first position where the first table top surface is maintained at said first predetermined height, said piston members being movable under the action of pressure within said pressurized cylinders to a second position where the first table top surface is maintained at said second predetermined height. The movement of the first table top surface occurring when clamping pressure is released from the piston members. It will be appreciated that the pressurized cylinders might be replaced by spring means in an alternative embodiment.

Preferably, the present invention provides a games table having both the aforesaid movable second table top surface and the aforesaid elevation mechanism for the first table top surface.

The present invention will now be described with reference to the accompanying drawings which illustrate by way of example, one preferred embodiment thereof, In the drawings.

Figure 1:
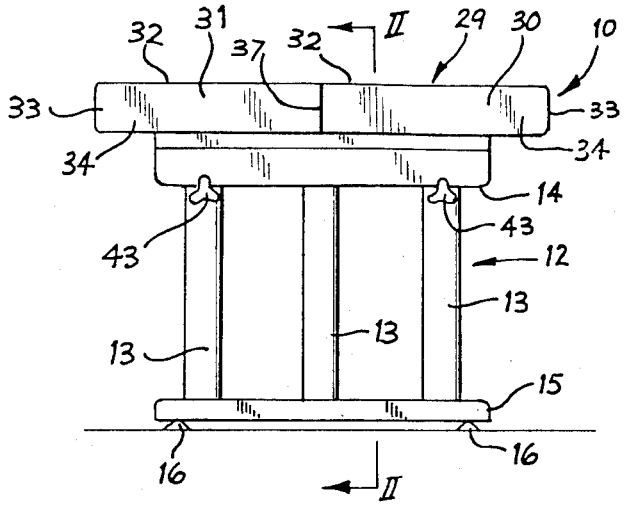
FIG. 1 is an end elevation view of the games table having its second or top table surface in a closed position covering the first or lower games playing table surface.

Referring now to the drawings there is shown a games table 10 having a pair of leg support structures 11 and 12 arranged substantially adjacent longitudinal ends of the table. The support structures are each formed by three upright leg members 13, a substantially horizontal upper bar 14 and a substantially horizontal lower bar 15. It will of course be appreciated that there need not necessarily be three upright leg members and leg construction consistent with the following description would equally be capable of use. For example there might be four legs, one generally at each corner of the table, or alternatively the leg support structures 11 and 12 might be formed by enclosed panels extending transversely across each end of the table. In the illustrated embodiment, conventional table leveling screw mechanisms 16 are provided underneath and at the lateral ends of each of the lower bars 15. A central longitudinally running support bar 17 is provided connecting the central legs 13 of each of the leg support structures 11, 12.

The first or lower games playing surface 18 is essentially formed on base plate 19 which may be slate or any other suitable material such as compressed particle board. The drawings illustrate a billiards, snooker or pool games table surface, however, it will be appreciated that the table might equally be employed for other games which are played on a table surface. The base plate 19 is supported on a frame structure 20, formed from square or rectangular steel tube material. Adjacent each end of the table playing surface 18, a cross bar 21 is provided extending transversely across the table surface 18 underneath and connected to the frame structure 20. The cross bars 21 are respectively aligned with each of the upper bars 14 of the leg support structures 11, 12.

Arranged along each longitudinal side edge and each end edge of the table surface 18 is a side wall structure 22 for the games playing area. The side wall structure comprises an upright wall member 23 extending above and below the base plate 19 and an upper capping member 24 and a lower capping member 25 respectively above and below the base plate 19 and joined to the outer upright wall member 23. A rubber side wall cushion 26 of conventional construction is illustrated joined to the upper capping member 24.

Figure 6:
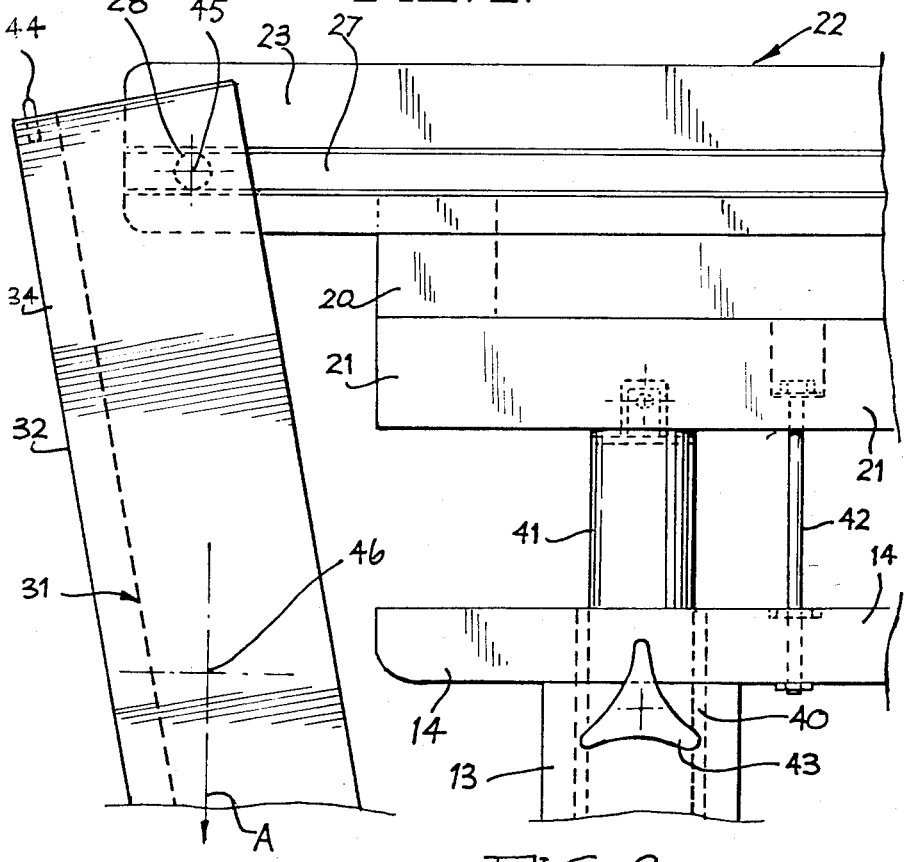
FIG. 6 is a detail view of the elevating mechanism and the means for maintaining and moving the top table surface relative the supporting legs of the table.
Figure 2:
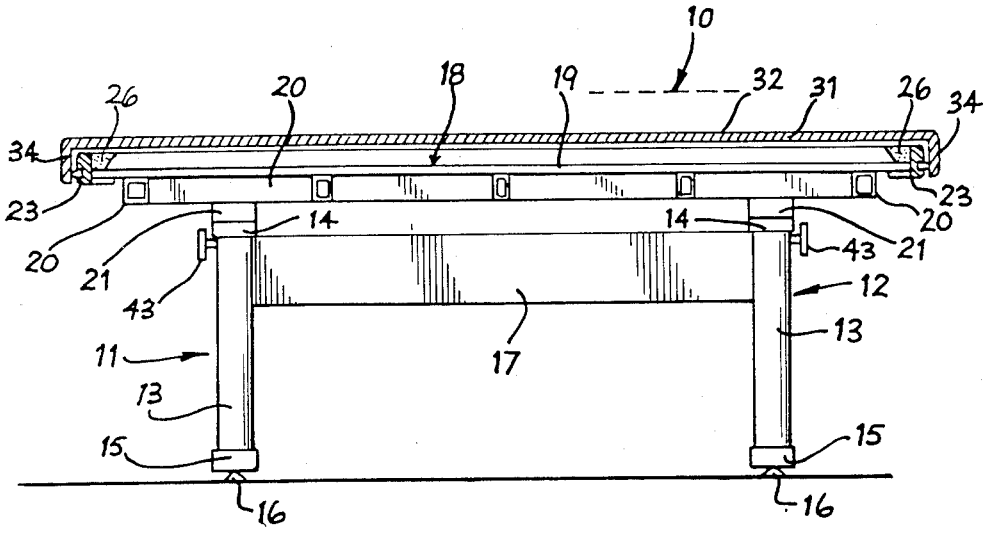
FIG. 2 is a longitudinal sectional view of FIG. 1 taken along line II—II.
Figure 4:
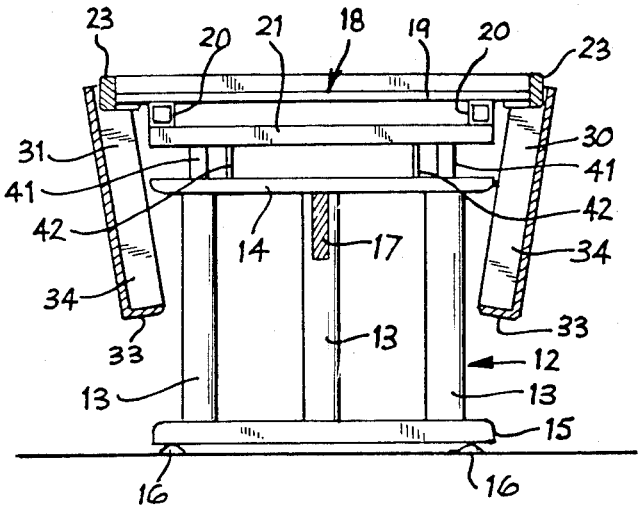
FIG. 4 is an end elevation sectional view of the table taken along line IV—IV of FIG. 3.
Figure 5:
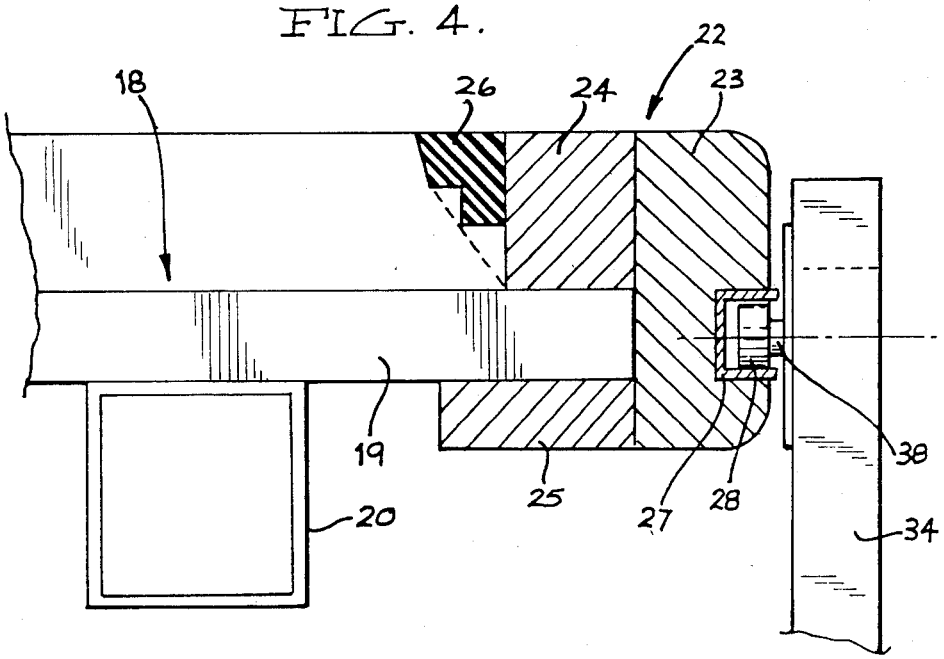
FIG. 5 is a detail sectional view of the area marked D on FIG. 3.

Referring now specifically to FIGS. 5 and 6 there is shown a generally square groove formed by a U-shaped aluminium channel section 27 extending along each end upright wall member 23 of the side wall structure 22. The U-shaped channel 27 opens outwardly and provides a guideway for roller 28 which is adapted to roll about a substantially horizontal axis of rotation 45. An upper or second table surface 29 is formed by a pair of table elements 30, 31. The table elements each comprise a substantially flat surface region 32 adapted to form the co-extensive top surface when in the closed or cover position illustrated in FIG. 1. The table elements also have one longitudinal side wall 33 depending from one side edge of the surface region 32 and a pair of depending end walls 34 of substantially the same depth as the side wall 33. The longitudinal side edges of the elements 30, 31 which are adapted to form the centre line 37 of the table do not have a side wall structure but rather include a tongue and groove connection arrangement 44 to ensure that the elements 30, 31 do form a co-extensive surface and to further ensure that the lower games table surface is fully protected when the elements 30, 31, are in the position shown in FIG. 1. Alternatively the elements 30, 31, in the closed position may include dowel, connecting elements, preferably formed from brass, to ensure that the elements 30, 31 do form a co-extensive surface. The aforesaid rollers 28 are connected respectively to each end wall 34 of both table elements 30, 31 adjacent the centre line 37 or end of the respective walls 34. Further, the axis of rotation 45 of each roller 28 is offset towards the lower edge of the depending end walls 34. The arrangement thus described enables the table top elements to be bodily rolled laterally sideways from the position shown in FIG. 1 and thereafter pivotally swung to the position depicted in FIGS. 4 and 6 where the elements 30, 31 depend downwardly adjacent to the side edges of the games table surface 18 and substantially beneath the table surface 18. Due to the aforesaid offset relationship of the rollers axis of rotation 45, the table elements 30, 31 depend downwardly and inwardly such that the centre of gravity 46 is disposed at least in line with the pivot axis 45 or inwardly therefrom as shown in FIG. 6 to minimize the degree of obstruction when the games table surface 18 is uncovered for use.

Figure 3:
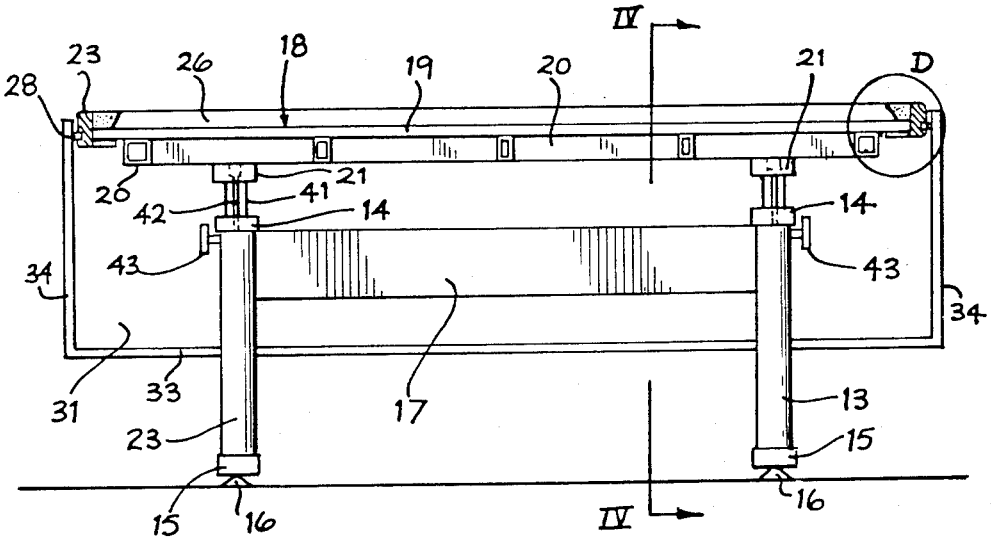
FIG. 3 is a longitudinal section view of the table similar to FIG. 2 with the second or top table surface in an open position uncovering the first or lower games playing table surface.

Referring now to FIGS. 3, 4 and 6, there is illustrated an elevation mechanism enabling the games table surface 18 to be raised relative to the leg support structures 11, 12. The elevation mechanism comprises a cylinder 40 formed within each of the outer legs 13 of the leg structures 11, 12. A second telescopic inner cylinder 41 is arranged to slide upwardly and downwardly within each of the cylinders 40. The cylinders 41 act as extendable elements and are connected to the cross bars 21 which are in turn secured to the frame structure 20 of the games table surface 18. A gas strud is housed within each cylinder 40, each gas strud comprising a cylinder pressurized with a gas or other similar medium with a piston and connecting rod. The gas struds are connected to the cylinders 40, 41 in such a way as to normally extend these cylinders and thereby elevate the games table surface 18. Associated with each cylinder combination 40, 41 is a limit bolt 42 secured to the cross bar 14 and permitted limited sliding movement through the cross bar 21 of the leg structures 11, 12. In this manner the amount of elevating movement of the games table surface 18 is controlled. The limit bolts 42 may also include means to rigidly fix the table surface 18 in the elevated position. When the games table surface 18 is to be maintained in a lowered position, it is pushed downwardly against the gas pressure in the cylinders 40 and clamped in the lowest position by clamps 43.

It will be appreciated that as depicted in the accompanying drawings the table elements 30, 31 in the closed or covered position shown in FIG. 1 form a dining table surface. It is not essential that this be the case, and in one possible alternative the elements 30, 31 might form a second games playing surface.

Figure 7:
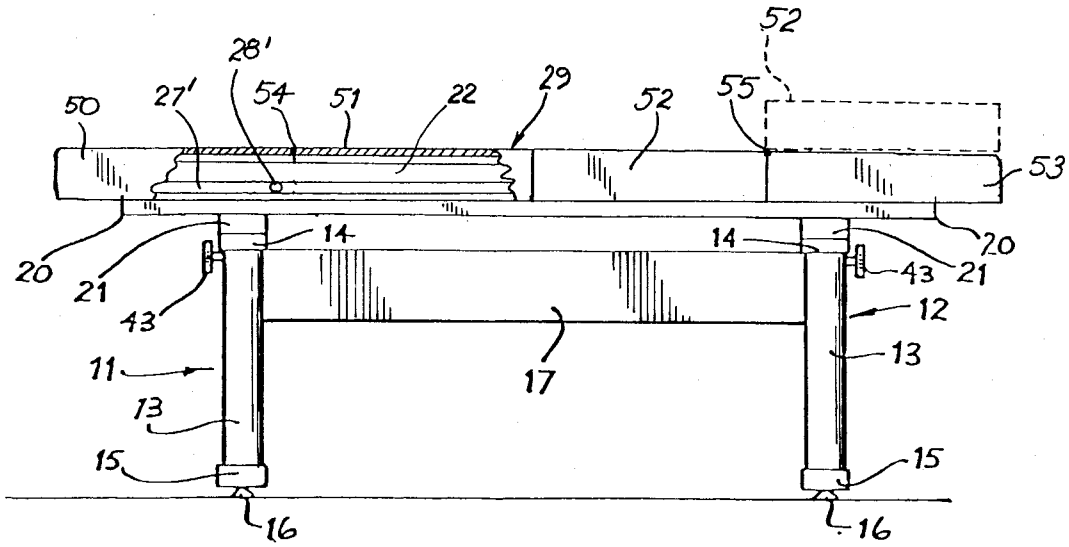
FIG. 7 is a longitudinal partly sectional view of a second embodiment of the present invention.

FIG. 7 of the accompanying drawings illustrate an alternative embodiment which may include an elevation mechanism as previously described with reference to FIGS. 3, 4 and 6. In this embodiment the upper or second table surface 29 is formed by four separate elements 50, 51, 52 and 53. The elements are separated from each other transversely across the table rather than longitudinally along the table with the elements 30, 31 of the embodiment of FIGS. 1 to 6. Further the two end elements 50, 53 are hinged to the other elements 51 and 52 respectively by hinge means 54, 55 such that the elements 51 and 52 can pivot to a position above and resting on the elements 50 and 53 respectively as shown in phantom outline in FIG. 7. Furthermore catch means (not shown) might be provided to secure the elements 50, 51 and 52, 53 together in the pivoted position. The side wall structure 22 of the games playing area includes a longitudinally extending outwardly facing channel 27′ which provides a guide way for rollers 28′ respectively connected to the table elements 50 and 53. In this manner, once the elements 51 and 52 have been pivoted, the combined elements 50, 51 and 53, 52 may be rolled outwardly and swung over the ends of the table in the same way as the elements 30, 31 are swung over the sides of the table in FIGS. 1 to 6.

It will of course be appreciated that this embodiment is particularly suited to large table areas, however with smaller tables a similar construction might be employed without the hinged elements 51 and 52.

We claim:

1. A games table comprising:

a first table top for use as a game playing surface;

leg support means for supporting said first table top in an essentially horizontal position at a first predetermined height above ground level;

elevation means between said leg support means and said first table top to move said first table top to a second predetermined position, and fastening means to secure said first table top at said first predetermined position or at said second predetermined position;

at least two second table top elements which can be moved to form a second table top;

upright wall means extending from said first table top for supporting said second table top elements in a co-extensive arrangement forming said second table top above said first table top; and means for providing rolled and pivoted movement of said second table top elements between either (i) positions essentially below said first table top, or (ii) said co-extensive arrangement forming said second table top, said means for providing rolled and pivoted movement including, (a) channel guide tracks and rollers, (b) each channel guide track having one roller arranged with respect thereto for rolling movement of said roller inside and along said channel guide track, (c) said rollers being mounted either from said upright wall means or from said second table top elements, and said channel guide tracks being mounted from the other of said upright wall means or said second table top elements, and (d) pivot axes, for each of said second table top elements, defined by said rollers so that each of said second table top elements can rotate to said positions essentially below said first table top, and the centers of gravity for each of said second table top elements being such that the top surfaces of each of said second table top elements are brought to non-vertical positions under said first table top when said second table top elements are in said positions essentially below said first table top.

2. A games table according to claim 1 in which said fastening means is adapted to secure said first table top at positions between said first and second predetermined positions.

3. A games table according to claim 1 in which limit means are provided for preventing movement of said first table top above said second predetermined position.

4. A games table according to claim 1 in which each of said second table top elements includes two surface elements, and for each of said second table top elements said two surface elements are hinged together.

* * * * *